US009580984B2

(12) United States Patent
Robertson et al.

(10) Patent No.: US 9,580,984 B2
(45) Date of Patent: Feb. 28, 2017

(54) APPARATUS AND METHODS FOR OVERCOMING AN OBSTRUCTION IN A WELLBORE

(71) Applicant: Robertson Intellectual Properties, LLC, Arlington, TX (US)

(72) Inventors: Michael C Robertson, Arlington, TX (US); William F. Boelte, New Iberia, TX (US); Douglas J. Streibich, Fort Worth, TX (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 171 days.

(21) Appl. No.: 13/815,694

(22) Filed: Mar. 14, 2013

(65) Prior Publication Data

US 2014/0262328 A1 Sep. 18, 2014

(51) Int. Cl.
*E21B 29/02* (2006.01)

(52) U.S. Cl.
CPC ..... *E21B 29/02* (2013.01)

(58) Field of Classification Search
CPC . E21B 7/007; E21B 29/02; E21B 7/18; E21B 43/11; E21B 43/114; E21B 43/116
See application file for complete search history.

(56) References Cited

U.S. PATENT DOCUMENTS 4,619,318 A * 10/1986 Terrell et al. ..... 166/55
8,256,521 B2 * 9/2012 Swor et al. ..... 166/376

* cited by examiner

*Primary Examiner* — Brad Harcourt

(57) ABSTRACT

Apparatus and methods for penetrating a downhole target within a wellbore include providing a body with a longitudinal axis, a first end, and a second end into a wellbore, the body having a nozzle at the first end. The nozzle is adapted to project a medium, such as molten thermite, in a direction generally parallel to the longitudinal axis, such as in a downhole direction. An initiation source is usable to consume a fuel load associated with the body to cause projection of the medium in a direction generally parallel to the axis of the wellbore, to affect an obstruction in the wellbore. A series of such apparatus can be used in succession, such that the actuation of each preceding apparatus enhances the effect of each subsequent apparatus on the obstruction.

16 Claims, 7 Drawing Sheets

APPARATUS AND METHODS FOR OVERCOMING AN OBSTRUCTION IN A WELLBORE

FIELD

Embodiments usable within the scope of the present disclosure relate, generally, to systems and methods usable to penetrate and/or otherwise overcome a downhole target and/or obstruction in a wellbore, and more specifically, to devices and methods for projecting a medium in a direction generally parallel to the axis of a wellbore (e.g., in an uphole or downhole direction) to remove, reduce, and/or otherwise affect debris, a downhole tool, or other similar obstructions and/or restrictions.

BACKGROUND

When drilling, completing, and/or otherwise forming or operating on a wellbore, it is often necessary to install and/or set devices that block, seal, restrict, or isolate a portion of the wellbore. For example, sub surface safety valves (which typically include a flapper valve), are deployed to restrict the egress of lower zoned material (e.g., oil and gas); however, it is common for flapper valves to become blocked or otherwise hindered or prevented from opening, preventing production or other operations. In other situations, foreign objects (e.g., "fish"), debris, and/or other objects, can become lodged within a wellbore, especially at restrictions in a wellbore. Such items can often present difficulties in removal due to the lack of fixation of the object in the wellbore and/or the material of the object (e.g., Inconel, Hastalloy, etc.)

Conventional methods for removing downhole obstructions include use of jars to apply a physical/mechanical force to such obstructions, pigs or similar fluid jetting systems typically used to clean a conduit (e.g., to remove paraffin or similar substances), and other similar systems that generally rely on physical/mechanical force to forcibly move an obstruction.

A need exists for apparatus and methods usable to penetrate, perforate, or erode a target that presents a blockage, obstruction, hindrance to travel, and/or inadequate flow path in a wellbore.

SUMMARY

Embodiments of the present disclosure relate generally to apparatus and methods usable for penetrating a downhole target (e.g., a packer, setting tool, or similar sealing/isolating device, a safety valve, a restriction, an obstruction, debris, etc.) within a wellbore. The apparatus, for penetrating the downhole target, can include a body having a nozzle formed at an end thereof, the nozzle being adapted to project a medium in a direction generally parallel to the axis of the wellbore (e.g., in a downhole or uphole direction). As such, the apparatus can be used to project molten fuel, a perforating jet or object, a blade, a corrosive medium, or other similar means for eroding, penetrating, perforating, or otherwise overcoming a blockage or restriction, in a downhole (e.g., axial) direction after placement of the apparatus above a blockage, or in an uphole direction (e.g., when positioned beneath a safety valve or sealing device that must later be overcome or removed).

A fuel load can be associated with the body, e.g., by placement therein, or placement in an adjacent body or receptacle that can be threaded or otherwise attached and/or associated with the body of the apparatus. An initiation source (e.g., a thermal generator or similar device) can also be provided, in communication with the fuel load, for causing consumption of the fuel load and subsequent projection of a medium through the nozzle, generally parallel to the longitudinal axis of the apparatus and the axis of the wellbore, thus enabling the medium to affect a wellbore obstruction located in an uphole or downhole direction relative to the apparatus.

For example, in an embodiment, the apparatus can be a torch or cutter having a nozzle formed in, attached to, or otherwise associated with the uphole and/or downhole end thereof, and the apparatus can be provided with a power source, such as thermite. Actuation of the initiation source thereby causes molten thermite to be projected through the nozzle in an uphole or downhole direction, to erode, degrade, penetrate, or otherwise affect a downhole obstruction. In various embodiments, one or more additional nozzles may also be provided, oriented to project a medium at an angle (e.g., perpendicular) relative to the axis of the apparatus, e.g., to allow selective and/or simultaneous use of the apparatus to cut, perforate, penetrate, and/or otherwise affect a wellbore conduit and/or a formation.

To overcome an obstruction, it may be desirable to perform multiple operations and/or use multiple variants of the embodied apparatus. For example, a first apparatus, having a nozzle with a first selected geometry, can be positioned relative to an obstruction, then actuated to cause projection of a medium toward the obstruction in a manner determined by the first selected geometry. A second apparatus, having a nozzle with a differing geometry, can then be positioned relative to the obstruction and actuated to project a medium toward the obstruction in a differing manner. The first and second geometries can be selected to have an enhanced and/or cumulative effect. For example, the first geometry can be selected such that actuation of the first device enhances the effectiveness of the second device. It should be understood that any number of devices, having any number of similar or differing nozzle geometries, can be used, for example, to form and progressively enlarge an opening in an obstruction, until a desired wellbore diameter is achieved.

In an embodiment, a stand-off member can be associated with the operative end of the apparatus (e.g., the end having the nozzle associated therewith). The stand-off member can include a dimension (e.g., a length) that provides a space between the nozzle and the obstruction in the wellbore, for preventing damage to the apparatus from the projection of the media toward the obstruction. For example, when positioning the apparatus in the wellbore, the apparatus can be lowered and/or raised until the stand-off member contacts the obstruction. The stand-off member thereby prevents further movement of the apparatus closer to the obstruction and maintains a distance between the obstruction and the body of the apparatus, such that when the medium is projected from the nozzle, the possibility of damage to the apparatus, resulting from this operation, is reduced.

In a further embodiment, the stand-off member can be formed from selected materials and/or otherwise adapted to be at least partially eroded by the medium to facilitate removal of the apparatus from the wellbore and/or subsequent repositioning of the apparatus closer to the obstruction. For example, a stand-off member formed at least partially from magnesium, used in conjunction with an apparatus configured to project molten thermite toward an obstruction, would be at least partially degraded through contact with the molten thermite. Additionally, in an embodiment, the stand-off member can be configured to seal the nozzle and/or the body to prevent entry of contaminants from the wellbore, e.g., through inclusion of a sealing portion/device/member and/or due to the construction of the stand-off member itself.

In an embodiment, the opposing end of the body (e.g., the end opposite the nozzle) can have a connector thereon (e.g., a threaded connector or other type of connection), usable to anchor and/or otherwise retain the apparatus in a generally fixed orientation relative to the wellbore. For example, the connector can be attached to an anchoring or setting device usable to engage the wellbore or otherwise maintain the position of the apparatus, such that when the fuel load is consumed and the medium is projected through the nozzle, the resulting force does not cause undesired movement of the apparatus (e.g., away from the obstruction.) In a further embodiment, a counterforce apparatus (e.g., an apparatus similar to the primary apparatus or any other type of apparatus capable of producing a force in a generally axial direction relative to the wellbore) can be provided in association with the body, and configured to apply an opposing force to the body that counteracts the force generated when the fuel load is consumed and the medium is projected through the nozzle. The counterforce apparatus can be configurable (e.g., provided with a selected force and/or duration) that corresponds to the geometry of the nozzle and/or the expected force of the fuel consumption and projection of the medium. In alternate embodiments, the apparatus can be provided with a latching member and/or similar protruding portion configured to engage a corresponding feature in the interior of the wellbore and/or the wellbore conduit.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1A:
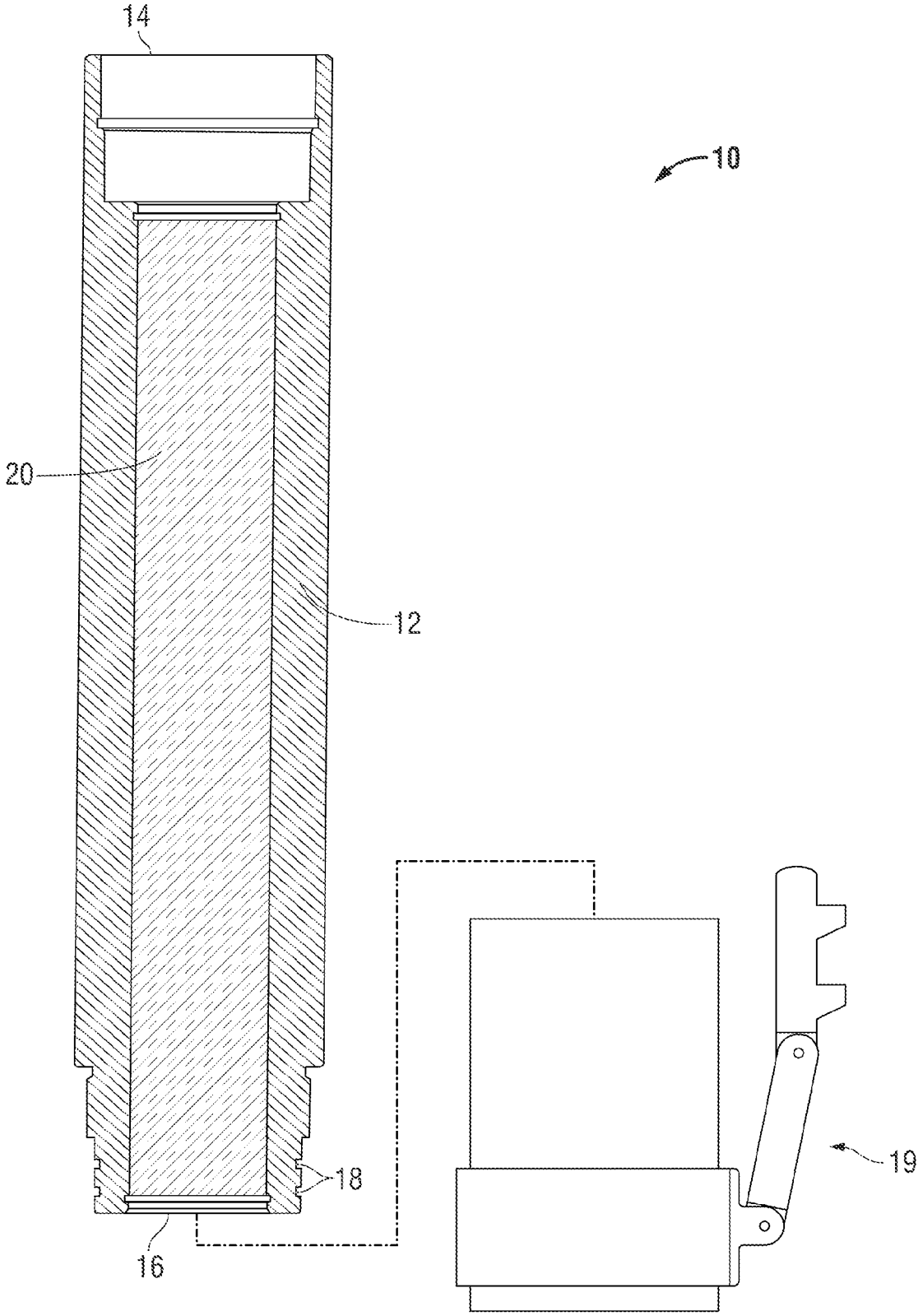
FIG. 1A depicts a cross-sectional view of an embodiment of an apparatus usable to project a medium in a direction generally parallel to an axis of a wellbore.

Referring now to FIG. 1A, a cross-sectional view of an embodiment of an apparatus (10) (e.g., a torch) adapted for projecting a medium in an axial (e.g., downhole or uphole) direction within a wellbore is shown. It should be understood that while FIG. 1A depicts a generally tubular, torch-like apparatus as an exemplary embodiment, any type of cutter, perforator (e.g., a perforating gun), or any other type of device, configured to project a medium in a manner to affect an obstruction in a wellbore, can be used without departing from the scope of the present disclosure. Additionally, as described below, while the depicted embodiment can be used as an apparatus for projecting a medium in an axial direction within a wellbore, the depicted embodiment could alternatively be attached (e.g., threaded) to one or more other apparatus usable to project a medium in an axial direction, such that the depicted apparatus (10) is usable as an associated container for retaining a fuel load therein.

Figure 1B:
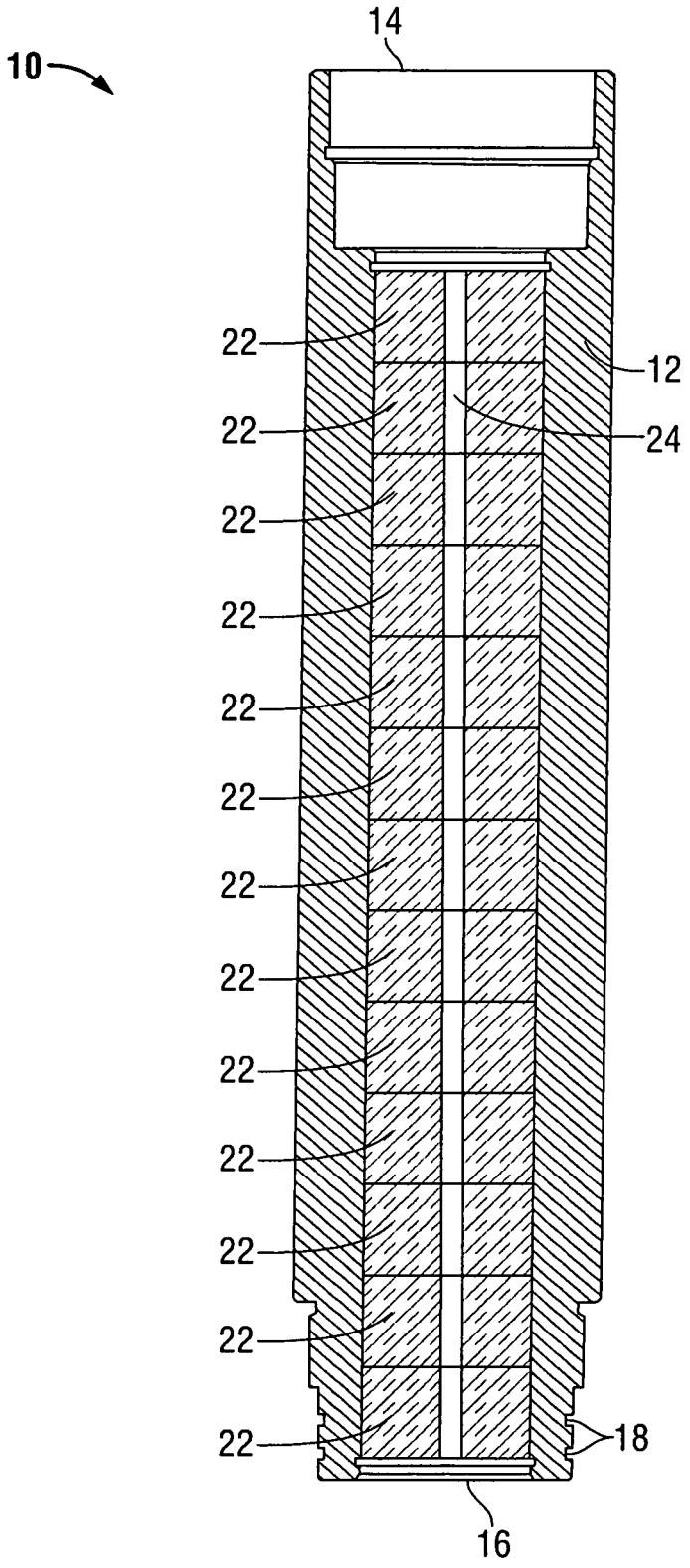
FIG. 1B depicts a cross-sectional view of an alternate embodiment of the apparatus of FIG. 1A.

Specifically, the depicted apparatus (10) is shown having an elongate, tubular body (12) having a box end (14) and a pin end (16), the pin end (16) depicted having sealing elements (18) (e.g., O-rings or similar elastomeric and/or sealing members) associated therewith. A fuel load (20) is shown disposed within and substantially filling the central bore of the body (12). In an embodiment, the fuel load (20) can include thermite and/or a mixture of thermite and one or more polymers adapted to produce a gas and/or force as the thermite combusts, such as the power source described in U.S. Pat. No. 8,196,515, which is incorporated herein by reference in its entirety. FIG. 1A depicts the body (12) containing a single piece of thermite (e.g., an elongate pellet or a densely packed concentration), though it should be understood that the fuel load (20) can include any type of usable power source having any form and/or quantity. For example, FIG. 1B depicts an alternate embodiment of an apparatus (10), in which the fuel load includes multiple, discrete pellets of thermite (22), each having a central passage therethrough (e.g., for increasing surface area), to define a continuous central passage (24).

In operation, either the box end (14) or pin end (16) of the depicted apparatus (10) can be configured to function as a nozzle, such that when the fuel load (20) is consumed (e.g., through actuation of a thermal generator or other type of ignition source), a medium (e.g., molten thermite) is projected through the box end (14), the pin end (16), or combinations thereof, generally parallel to the axis of the body (12) and the axis of a wellbore within which the body (12) is positioned. The medium can subsequently affect an obstruction within a wellbore (e.g., debris, a valve, a setting tool, a restriction, or other similar types of obstacles) located in an axial direction (uphole or downhole) relative to the apparatus (10), e.g., by at least partially degrading, perforating, penetrating, and/or eroding the obstruction.

As described above, however, the depicted apparatus (10) can be used in conjunction with additional containers and/or apparatus containing additional fuel, or the depicted apparatus (10) can function as a carrier for a fuel load (20) for use by an associated apparatus. Similarly, an initiation apparatus can be threaded to and/or otherwise engaged with either end (14, 16) of the apparatus (10), and/or other attachments and/or components can be engaged with the depicted apparatus (10), such as a stand-off member, an anchor (19) and/or attachment/latching mechanism, or other similar components, as described above and below.

Figure 2A:
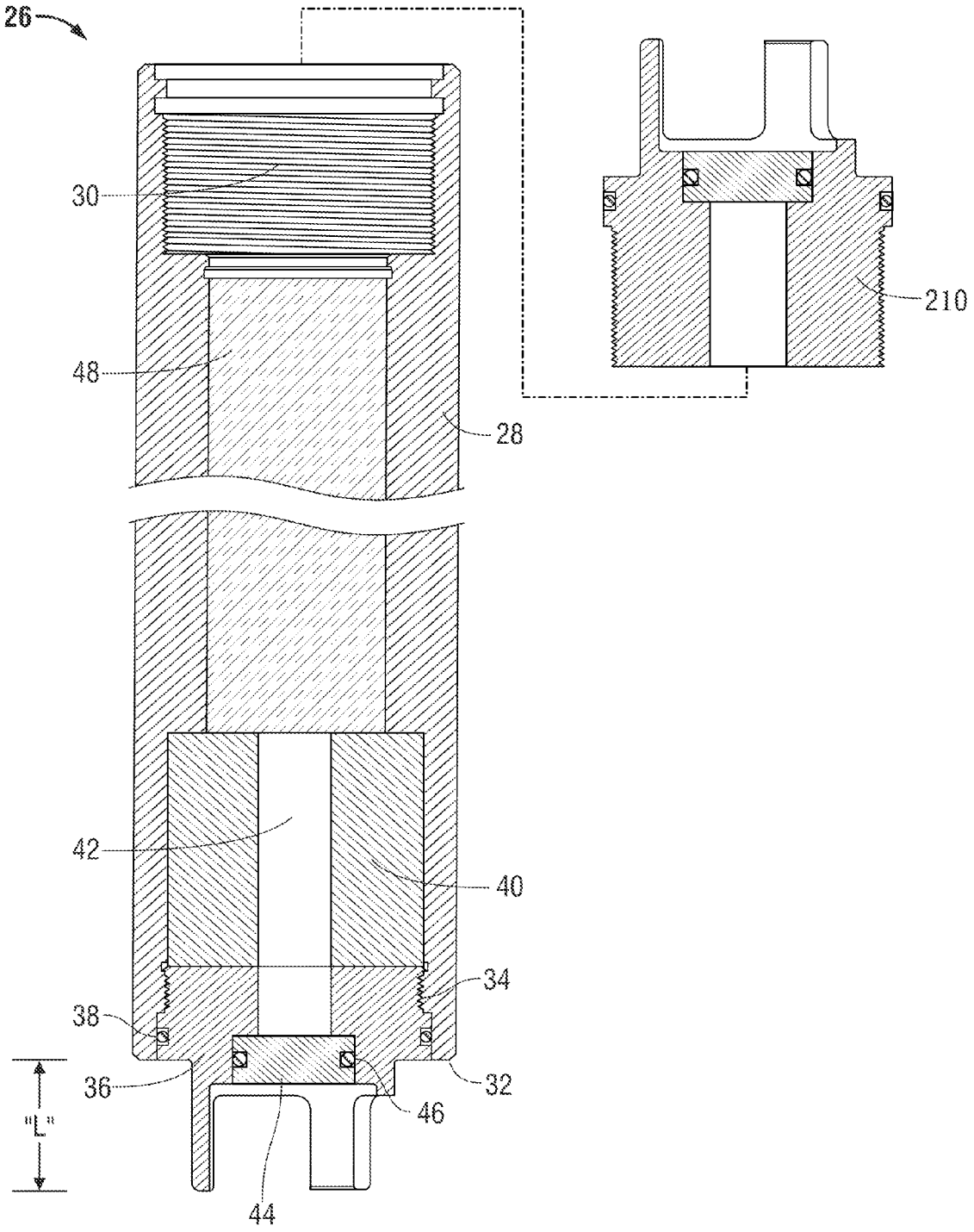
FIG. 2A depicts a cross-sectional view of an embodiment of an apparatus usable to project a medium in a direction generally parallel to an axis of a wellbore.

Referring now to FIG. 2A, a cross-sectional view of an embodiment of an apparatus (26) (e.g., a torch), usable within the scope of the present disclosure is shown. The apparatus (26) is depicted having a generally tubular body (28) with a first end (30) having threads and/or a box connection, and a second end (32). The second end (32) is depicted having interior threads (34), usable for engagement with a stand-off member (36). The stand-off member (36) is shown engaged with the body (28) via the threads (34), and a sealing member (38) (e.g., an O-ring or similar element) is shown secured between the stand-off member (36) and the interior surface of the body (28). As described above, the stand-off member (36) can be usable to provide a space between the second end (32) of the body (28) and an object and/or obstruction in the wellbore, such as through contact between the obstruction and one or more protruding portions of the stand-off member (36). Specifically, FIG. 2A shows the stand-off member (36) having a plurality of protruding elements extending beyond the second end (32) of the body (28) a selected length (L), which provides an effective space between the body (28) and an obstruction in the wellbore, such that the projection of a medium from the apparatus (26) toward the obstruction will be less likely to damage and/or otherwise affect the body (28) of the apparatus (26).

The depicted embodiment of the apparatus (26) is shown having an insert (40) disposed within the body (28) proximate to the second end (32), which in an embodiment, can be formed from graphite or a similar material that will remain generally unaffected by the consumption of a fuel load and the projection of a medium. The insert (40) is shown having an internal bore, which is continuous with a bore through the stand-off member (36), defining a nozzle (42) at the second end (32) of the body (28). The stand-off member (26) is depicted having a seal and/or plug (44) engaged therewith, over the nozzle (42), with an associated O-ring or similar sealing member (46), such that the seal and/or plug (44) blocks the opening of the nozzle (42) while the apparatus (26) is lowered and/or otherwise positioned within the wellbore. The seal and/or plug (44) thereby prevent(s) the entry of contaminants into the nozzle (42) and body (28), until the apparatus (26) is actuated. Consumption of the fuel load (48), which in an embodiment, can include thermite and/or a thermite-polymer mixture, causes projection of a medium (e.g., molten thermite and/or gas) through the nozzle (42), which removes and/or penetrates or otherwise degrades the seal and/or plug (44), and further affects an obstruction located in an axial direction relative to the apparatus (26) (e.g., proximate to the second end (32) thereof.)

Figure 2B:
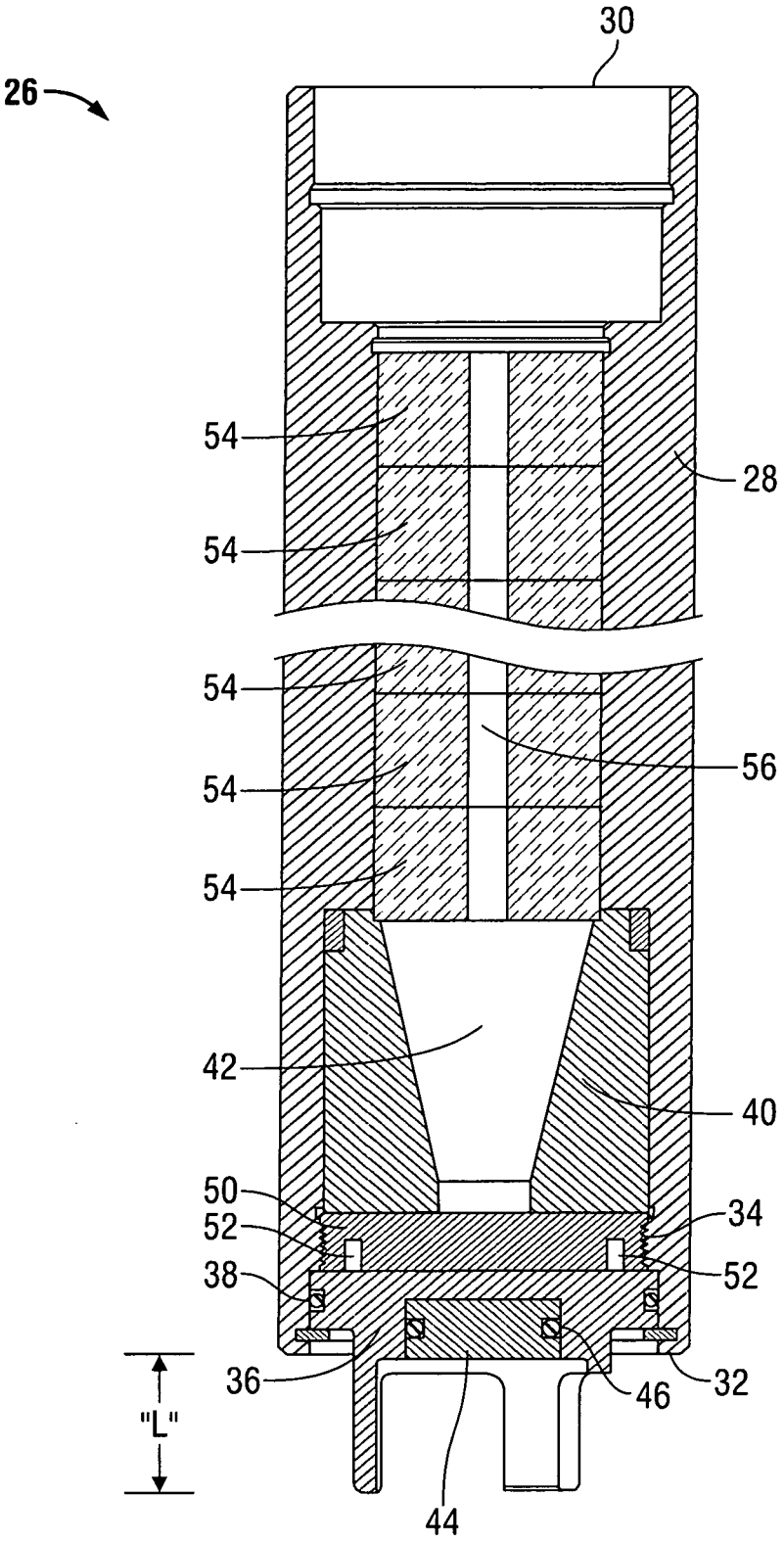
FIG. 2B depicts a cross-sectional view of an alternate embodiment of the apparatus of FIG. 2A.

It should be understood that the nozzle (42), the fuel load (48), the stand-off member (36), and other components of the apparatus (26) can be readily varied and/or provided having other dimensions, shapes, and/or forms without departing from the scope of the present disclosure. For example, FIG. 2B depicts an alternate embodiment of an apparatus (26), in which the stand-off member (36) can be adjustably secured to the body (28) by way of tightening pins and/or screws (52), which can secure the stand-off member (36) to a plug and/or retainer (50). Additionally, FIG. 2B depicts the insert (40) having a generally conical interior profile, which defines the shape of the nozzle (42), the characteristics of the medium projected therethrough, and the corresponding effect on a downhole obstruction. As described previously, to overcome an obstruction, it may be desirable to use multiple apparatus in succession, each with a differing nozzle geometry, such that actuation of a previous apparatus enhances the effect of each subsequent apparatus when used to penetrate and/or otherwise affect the obstruction. FIG. 2B also shows the fuel load including multiple discrete pellets (54) of thermite that define a continuous interior channel (56) therethrough, rather than a solid, compressed, and/or single-piece, fuel load as shown in FIG. 2A.

Figure 3A:
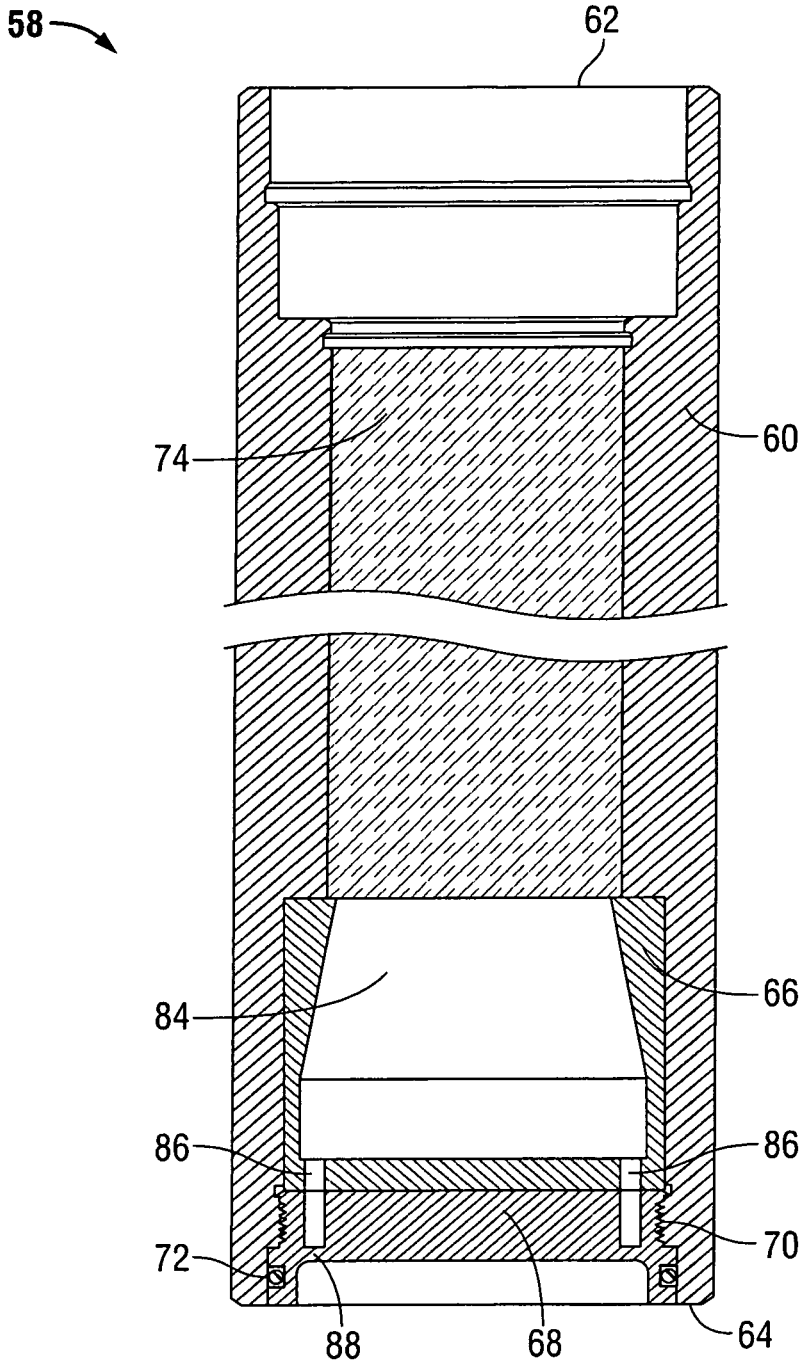
FIG. 3A depicts a cross-sectional view of an embodiment of an apparatus usable to project a medium in a direction generally parallel to an axis of a wellbore.

Referring now to FIG. 3A, a cross-sectional view of an embodiment of an apparatus (58) (e.g., a torch), usable within the scope of the present disclosure is shown. The apparatus (58) is depicted having a generally tubular body (60) with a first end (62) having threads and/or another type of box connector associated therewith, and a second end (64). The body (60) is shown having an insert (66) positioned within the interior of the body (60) and proximate to the second end (64), which, in an embodiment, the insert (66) can be formed from graphite or a similar material that will remain generally unaffected by the consumption of a fuel load and the projection of and/or contact with a medium. The depicted insert (66) is shown having a generally frustoconical interior shape, with a lower portion having one or more openings therein, which defines a nozzle (84) that includes a generally broad, upper section that narrows to one or more of channels (86), which pass through the lower portion of the insert (66). A plug and/or seal (68) is shown engaged with the second end (64) of the body, between the nozzle (84) and the exterior of the apparatus (58), via interior threads (70) within the body (60). An O-ring or similar sealing element (72) can be positioned between the plug and/or seal (68) and the body (60). The plug and/or seal (68) is shown having grooves, indentations, and/or channels that are continuous with the channels (86) within the insert (66), such that when the fuel load (74) is consumed, the medium (e.g., molten thermite) can enter the nozzle (84), pass into the channels (86), and then penetrate, perforate, and/or otherwise erode a narrow portion (88) of the plug and/or seal (68), between the nozzle (84) and the exterior of the apparatus (58).

Figure 3B:
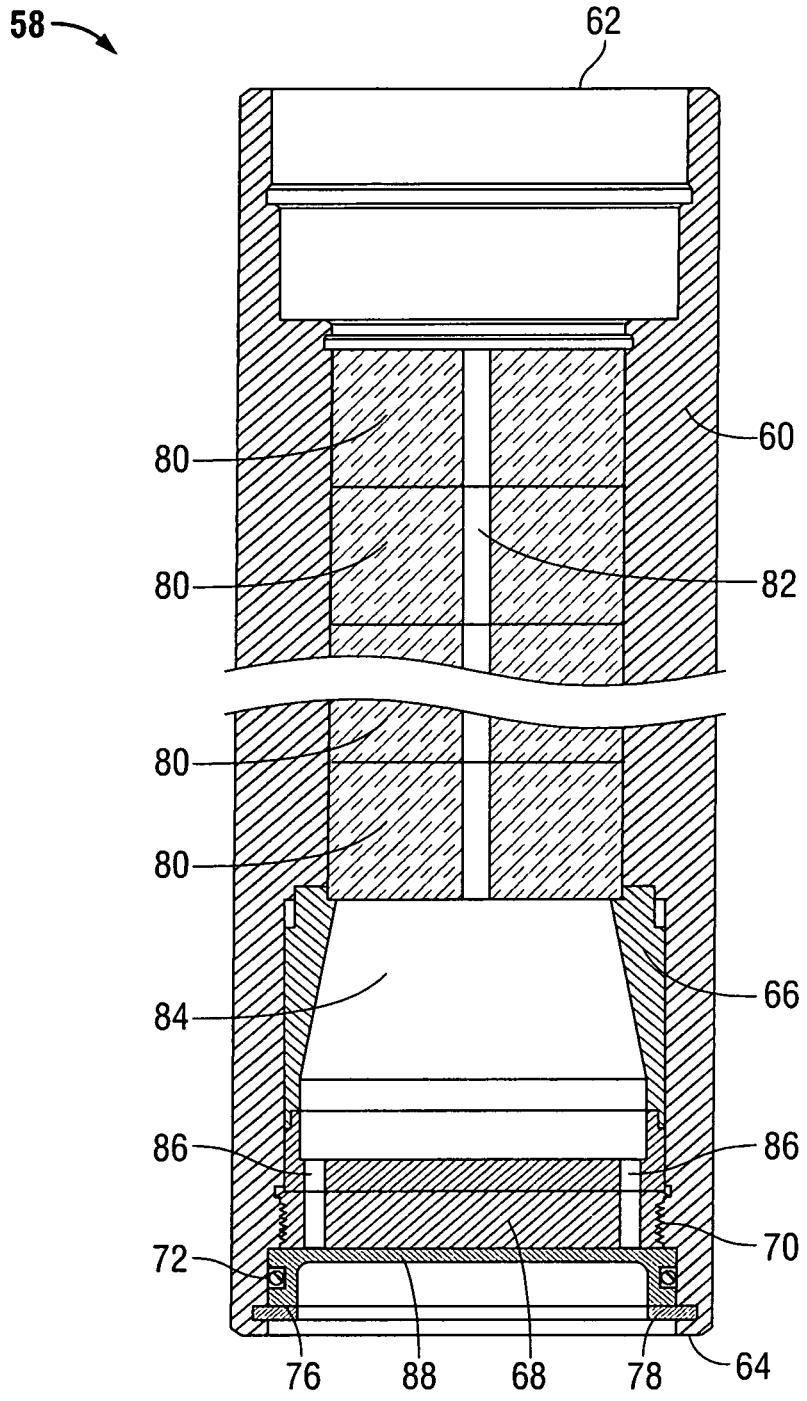
FIG. 3B depicts a cross-sectional view of an alternate embodiment of the apparatus of FIG. 3A.

It should be understood that various components of the depicted apparatus (58) can be readily modified without departing from the scope of the present disclosure. For example, FIG. 3B depicts an apparatus (58), in which the fuel load includes multiple discrete pellets (80) of thermite and/or a thermite-polymer mixture, with a contiguous central passageway (82) extending therethrough. The insert (66) is shown including a lower portion, with an angled and/or convex surface, to facilitate guiding molten thermite and/or another similar medium from the broad region of the nozzle (84) into the channels (86). Additionally, the plug and/or seal (68) is shown as a two part component in which an upper portion thereof (68) (e.g., an insert) is abutted by a plug and/or sealing member (76) of a lower portion (88), in which the plug and/or sealing member (76) can be retained in place via a snap ring (78) or similar retaining member.

Each of the embodiments shown in FIGS. 1A through 3B are exemplary embodiments of apparatus usable to project a medium in a direction generally parallel to the axis of a wellbore (e.g., in an uphole and/or downhole direction); and as such, it should be understood that any type of torch, cutter, perforating device, or other similar apparatus configured to project a medium in an axial direction can be used without departing from the scope of the present disclosure.

In use, any of the above-described embodiments, and/or another similar apparatus configured to project a medium in an axial direction can be positioned within a wellbore (e.g., by lowering the apparatus via a conduit engaged with the upper end/top connector thereof). The apparatus can be anchored in place, such as through use of a positioning and latching system, such as that described in published United States Patent Application 2011/0120731, which is incorporated herein by reference in its entirety. For example, a latching member can be engaged to an embodiment of the present apparatus via a connection to the upper end/top connector thereof. In other embodiments, various other types of anchors, setting tools, and/or securing devices can be used to retain the apparatus in a generally fixed position within a wellbore without departing from the scope of the present disclosure.

In a further embodiment, any of the above-described embodiments, and/or another similar apparatus configured to project a medium in an axial direction can be positioned within a wellbore, facing a first direction (either uphole or downhole), while a second identical or similar apparatus can be provided, facing the opposite direction. The two apparatus can be actuated simultaneously, such that the force produced by the second apparatus (e.g., a counterforce apparatus (210)), counteracts and/or otherwise opposes the force applied to the first apparatus by consumption of the fuel load and projection of the medium, thereby retaining both apparatus in a generally fixed position within the wellbore during use. The nozzle geometry, fuel load, and/or other characteristics of the second/counterforce apparatus (210) can be selected based on the nozzle geometry, fuel load, and/or other expected forces associated with the first apparatus.

Figure 4D:
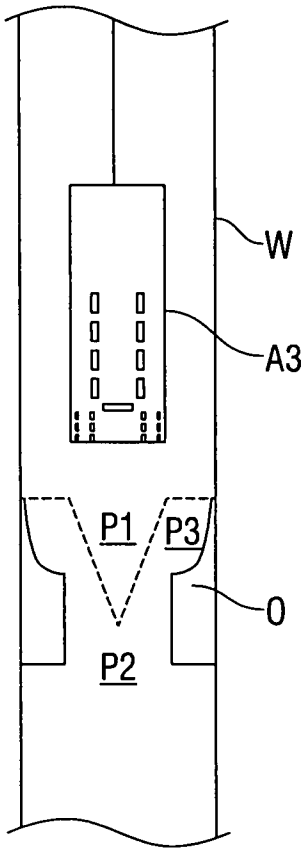
FIGS. 4A through 4D depict diagrams showing an embodiment of a method usable within the scope of the present disclosure.
Figure 4C:
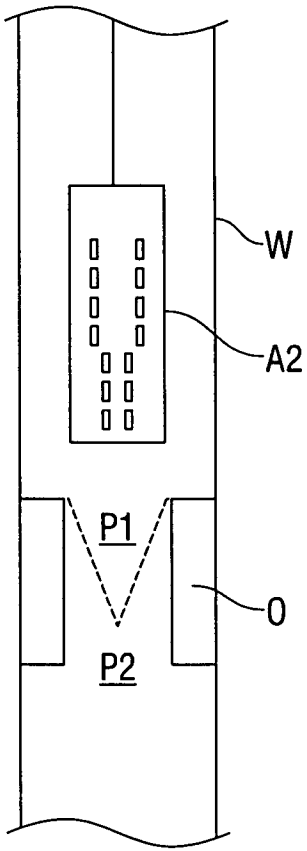

As described above, depending on the nature of an obstruction in a wellbore, it may be desirable to use multiple apparatus in succession, each having a differing nozzle geometry. For example, FIG. 4A depicts a diagram showing a portion of a wellbore (W), within which an obstruction (O) to flow and/or other operations is shown. Possible obstructions can include, by way of example, malfunctioning valves, setting and/or sealing devices, debris, or any other obstacle and/or restriction to flow through the wellbore (W).

Figure 4B:
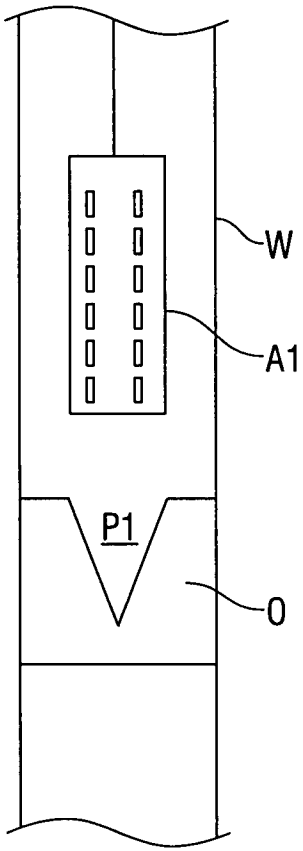
Figure 4A:
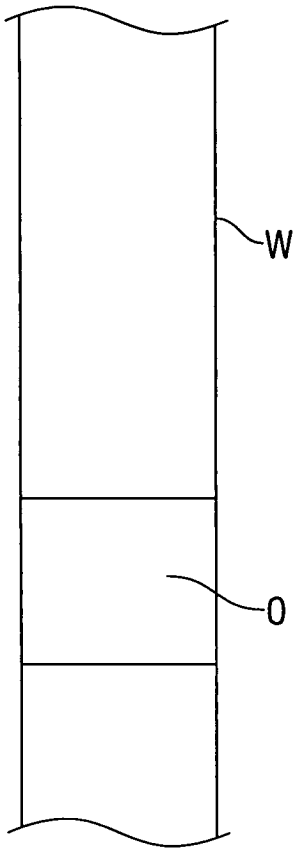

A first apparatus (A1), such as an apparatus similar to that shown in FIG. 1A, can be positioned relative to the obstruction (O), as depicted in FIG. 4B. Actuation of the first apparatus (A1), to project a medium in an axial (e.g., downhole) direction toward the obstruction (O), affects the obstruction (O) by forming a first perforation and/or erosion (P1) therein.

Following use of the first apparatus (A1), a second apparatus (A2), such as an apparatus similar to that shown in FIG. 2A, can be positioned relative to the obstruction (O), as depicted in FIG. 4C. Actuation of the second apparatus (A2) to project a medium in an axial (e.g., downhole) direction toward the obstruction (O) affects the obstruction (O) by forming a second perforation and/or erosion (P2) therein. The existence of the first perforation and/or erosion (P1) enhances the effectiveness of the second apparatus (A2), such that the combined and/or synergistic effect of using the second apparatus (A2), following use of the first apparatus (A1), exceeds the theoretical sum of the individual effectiveness of each apparatus (A1, A2).

Following use of the second apparatus (A2), a third apparatus (A3), such as an apparatus similar to that shown in FIG. 3A, can be positioned relative to the obstruction (O), as depicted in FIG. 4D. Actuation of the third apparatus (A3) to project a medium in an axial (e.g., downhole) direction toward the obstruction (O) affects the obstruction (O) by forming a third perforation and/or erosion (P3) therein. The existence of the first and/or second perforations and/or erosions (P1, P2) enhances the effectiveness of the third apparatus (A3), such that the combined and/or synergistic effect of using the third apparatus (A3), following use of the previous apparatus (A1, A2), exceeds the theoretical sum of the individual effectiveness of each apparatus (A1, A2, A3). It should be understood that the method illustrated in FIGS. 4A through 4D is a single exemplary embodiment, and that any number and/or type of apparatus can be used, in any order, without departing from the scope of the present disclosure, and that in some circumstances, use of a single apparatus can adequately overcome an obstruction, while in other circumstances, use of more than three apparatus may be desired. Further, while FIGS. 4A through 4D depict an embodiment in which a series of apparatus (A1, A2, A3) are lowered into a wellbore (W) to affect an obstruction (O), by projecting a medium in a downhole direction, in other embodiments, one or more apparatus could be lowered into a wellbore prior to the intentional or unintentional creation of an obstruction above the apparatus (e.g., in an uphole direction therefrom). Subsequently, the one or more apparatus could be actuated to project a medium in an uphole direction to overcome the obstruction.

Embodiments usable within the scope of the present disclosure thereby provide apparatus and methods usable to penetrate, perforate, and/or erode a target that presents a blockage, hindrance to travel, and/or inadequate flow path in a wellbore, through the projection of a medium in an axial (e.g., downhole or uphole) direction to affect the obstruction.

While various embodiments usable within the scope of the present disclosure have been described with emphasis, it should be understood that within the scope of the appended claims, the present invention can be practiced other than as specifically described herein.

What is claimed is:

1. An apparatus for penetrating a downhole obstruction, the apparatus comprising:

a body having a longitudinal axis and configured to contain a fuel load comprising thermite and an ignition source such that an ignition of the fuel load generates a projection of molten thermite; and a first end of the body comprising a nozzle configured to project the projection of molten thermite in a direction substantially parallel to the longitudinal axis of the body, wherein the nozzle comprises a profile configured to shape the projection of molten thermite to penetrate through the downhole obstruction.

2. The apparatus of claim 1, further comprising a stand-off member associated with the first end of the body, wherein the stand-off member has a dimension that provides a space between the nozzle and the downhole obstruction in the wellbore.

3. The apparatus of claim 2, wherein the stand-off member is removable from the body and replaceable for enabling the apparatus to be spaced a selected distance from the downhole obstruction.

4. The apparatus of claim 2, wherein the stand-off member is adapted to be at least partially eroded by the molten thermite.

5. The apparatus of claim 2, wherein the stand-off member comprises a sealing device for preventing passage of contaminants from the wellbore into the nozzle, the body, or combinations thereof.

6. The apparatus of claim 1, further comprising a connector associated with a second end of the body, wherein the connector, a device attached to the connector, or combinations thereof, anchors the body in a generally fixed orientation relative to the wellbore to prevent movement of the body due to actuation of the ignition source, consumption of the fuel load, and projection of the molten thermite.

7. The apparatus of claim 1, further comprising at least one additional nozzle positioned at an angle relative to the longitudinal axis, wherein consumption of the fuel load further causes projection of the molten thermite through said at least one additional nozzle.

8. A method for at least partially removing an obstruction from a wellbore having an axis, the method comprising:

positioning an apparatus up-hole or downhole of the obstruction, the apparatus comprising a longitudinal axis, a fuel load comprising thermite, an ignition source, and a nozzle, wherein the positioning comprises substantially aligning the longitudinal axis of the apparatus parallel with the axis of the wellbore;

igniting the fuel load with the ignition source, thereby generating molten thermite; and projecting the molten thermite through the nozzle and at the obstruction in a direction substantially parallel to the longitudinal axis of the apparatus, wherein the nozzle comprises a profile configured to shape the projected molten thermite to penetrate through the obstruction.

9. The method of claim 8, wherein the step of positioning comprises providing a space between the nozzle and the obstruction with a stand-off member of the apparatus.

10. The method of claim 9, wherein projecting the molten thermite through the nozzle causes the stand-off member to at least partially erode.

11. The method of claim 8, further comprising sealing the apparatus to prevent a passage of contaminants from the wellbore into the apparatus.

12. The method of claim 8, further comprising anchoring the apparatus in a generally fixed orientation relative to the wellbore to prevent a movement of the apparatus.

13. The method of claim 12, wherein the step of anchoring is affected by a counterforce apparatus counteracting a force caused by the projection of the molten thermite through the nozzle.

14. The method of claim 13, further comprising the step of providing the counterforce apparatus with an output, a duration, or combinations thereof, that corresponds to the geometry of the nozzle, the force, or combinations thereof.

15. The method of claim 8, the method further comprising:

positioning a second apparatus up-hole or downhole of the obstruction, the second apparatus comprising a longitudinal axis, a fuel load comprising thermite, an ignition source, and a nozzle, wherein the positioning comprises substantially aligning the longitudinal axis of the second apparatus parallel with the axis of the wellbore igniting the fuel load with the ignition source, thereby generating molten thermite; and projecting the molten thermite through the nozzle and at the obstruction in a direction substantially parallel to the longitudinal axis of the second apparatus.

16. The method of claim 15, wherein the nozzle of the second apparatus comprises a profile that is different from the profile of the first apparatus to enhance the penetration of the second apparatus.

* * * * *